United States Patent [19]

Cooper

[11] 4,206,570

[45] Jun. 10, 1980

[54] DEVICE FOR SUPPORTING A VESSEL

[76] Inventor: William E. Cooper, 2821 Mynatt Dr., Knoxville, Tenn. 37901

[21] Appl. No.: 896,737

[22] Filed: Apr. 17, 1978

[51] Int. Cl.[2] ..... A47B 91/00

[52] U.S. Cl. ..... 47/71; 248/346.1; 215/100.5

[58] Field of Search ..... 215/100.5; 248/346.1, 248/350; 47/71, 80

[56] References Cited

U.S. PATENT DOCUMENTS

| | | | |
|---|---|---|---|
| 290,520 | 12/1883 | Brauer | 248/346.1 |
| 821,208 | 5/1906 | Voss | 248/346.1 |
| 2,652,703 | 9/1953 | Keegan | 248/346.1 |
| 2,688,858 | 9/1954 | Cosmetto | 248/346.1 |
| 2,893,163 | 7/1959 | Hazel | 248/346.1 |
| 2,989,205 | 6/1961 | Yaws | 47/71 X |
| 3,018,014 | 1/1962 | Opolion | 215/100.5 |
| 3,797,796 | 3/1974 | Lansdowne | 248/346.1 |
| 4,089,498 | 5/1978 | Woodruff | 248/346.1 |

FOREIGN PATENT DOCUMENTS

| | | | |
|---|---|---|---|
| 58881 | 3/1912 | Switzerland | 248/346.1 |

*Primary Examiner*—Robert E. Bagwill

*Attorney, Agent, or Firm*—Pitts & Kesterson

[57] ABSTRACT

A device for supporting a vessel, such as a flower pot and for containing water or liquid draining therefrom is disclosed. The device comprises a flat liquid impervious base covered by a layer of absorbent material which is clamped to the flat base. Sides are also included to contain liquid in excess of that that can be absorbed by the absorbent layer.

4 Claims, 9 Drawing Figures

DEVICE FOR SUPPORTING A VESSEL

BACKGROUND OF THE INVENTION

This invention relates to devices used for collecting or containing liquid which drains or leaks from a vessel set thereon. More particularly this invention relates to devices for containing water coming from flower pots and the like wherein the possibility exists that a great deal of liquid must be contained and prevented from contacting furniture or otherwise spilled or lost. The device of this invention is particularly useful in those instances where it would be desirable for the contained liquid to be reabsorbed by the container from which it came. U.S. Pat. No. 1,971,337 issued to Harold B. Collins illustrates a typical coaster design for protecting furniture and the like from moisture which condenses on the exterior surfaces of the tumbler or other vessel holding cold liquids. The coaster described in Mr. Collins' patent has an upper layer of absorbent material such as blotting paper. This absorbent layer is then secured to a bottom layer of stiff paper, wood, etc. by a moistureproof adhesive. Although the blotting paper used in the Collins' device is suitable for absorbing the small amounts of condensed moisture which may collect on the exterior surfaces of a tumbler or other vessel, it is in no way suitable for absorbing or otherwise containing the large amounts of liquid that are associated with the watering of plants and for which the present invention is intended.

In U.S. Pat. No. 1,872,046 issued to Merwyn C. Teague there is disclosed a closure for containers such as bottles, cans and the like. In this patent, a layer of grainless rubber and a layer of paper are laminated together to provide a strong air tight closure for jars, cans, etc. However, this invention in no way discusses much less describes the unique water holding capabilities of the device in the present invention. Other patents which are also somewhat relevant to the present invention, but which are even less applicable than the two patents previously discussed include U.S. Pat. No. 55,402 to C. Weber; U.S. Pat. No. 451,645 to K. B. Tudor; U.S. Pat. No. 1,531,061 to D. Anderson; U.S. Pat. No. 2,632,286 to J. K. Newhall; and U.S. Pat. No. 2,829,459 to I. A. Halpern.

SUMMARY OF THE INVENTION

Since the use and display of plants has always been a practice of mankind, and since there is no evidence that such use and display of plants will be decreasing in the future, it is important now, as it has always been, that suitable means exist whereby the plants can be provided the proper amount of nourishing liquid without at the same time causing damage to furniture or other structures upon which they are set. Therefore, it is an object of this invention to provide means upon which flower pots and other plant vessels may be set which will collect and contain the excess liquid from the flower pot and thereby protect the surface upon which it is sitting.

It is a further object to provide means which will absorb the liquid draining from a flower pot or vessel such that even if the device of this invention is tilted or inverted the liquid would not be spilled.

Still another object of the present invention is to provide means whereby the liquid contained by the device of this invention may be reabsorbed and used by the plant held in the flower pot from which the excess liquid came.

It is still another object of the present invention to provide an inexpensive and simple device which is structurally strong such that it can support the plant with its container as well as absorbing or containing excess liquid draining from said flower pot or vessel.

Briefly, the device of this invention comprises a protective device for supporting a vessel and containing liquid draining from the vessel. Thus, the device provides protection to furniture, shelving or any other support structures on which the vessel may be set to avoid physical scratches and liquid staining or marring. The device comprises a flat liquid impervious base which has sides suitable for containing liquid. The sides also include an edge for clamping a layer of absorbent material which has a plane which is parallel and coextensive with the flat base structure and within the sides of the base structure. Thus, in operation liquids draining from the supported vessel and onto the protective device which is in excess of that that can be absorbed by the absorbent layer of material will be contained by the sides.

DETAILED DESCRIPTION OF THE INVENTION

Figure 1:
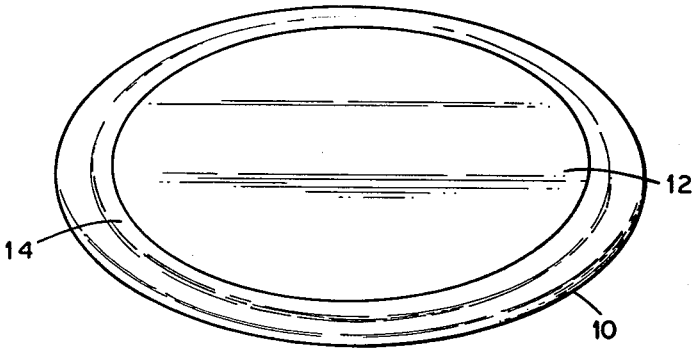
FIG. 1 is a perspective view of one embodiment of this invention showing a circular surface area.
Figure 2:
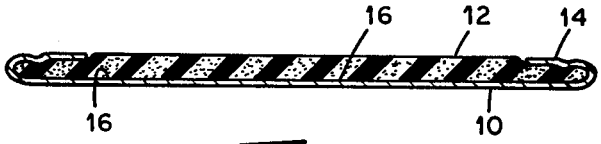
FIG. 2 represents a cross-section of the device shown in FIG. 1.

Referring to FIG. 1, there is shown a perspective view of the support and liquid containing device of this invention having a circular shape. It should be understood, of course, that although a circular shape is shown and may be the most convenient shape for the device of the present invention, the invention could certainly be of any shape including regular shapes such as square, rectangular, hexagon, octagon, or an irregular shape, etc. The shape of the device has no effect upon its abilities to function and in no way is important to the invention except that the cost of manufacturing the device of unusual shapes would likely be more expensive. FIG. 2 illustrates a cross-sectional view of the device of FIG. 1, and FIGS. 1 and 2 in combination will be referred to in the description of the following embodiment of this invention. As illustrated, the base or support structure 10 is made from a rigid or semi-rigid material such as lightweight sheet metal, other malleable metal or molded plastic and the like. Base support structure 10 may be made of most any material that is readily worked or molded and is substantially impervious to liquids. A layer 12 of absorbent material such as cloth, paper toweling, sponge rubber or any other such material that will absorb liquids lies on top of, and has a plane which is parallel and coextensive with, the supporting base structure 10. As shown in the present embodiment the rigid or semi-rigid supporting base structure 10 provides a lip 14 under which layer 12 of the absorbent material is securely held to the supporting base structure 10. If the base supporting structure 10 is made from a malleable material such as metal, aluminum or tin foil or the like, lip 14 may be crimped in place over absorbent layer 12. In the event that a plastic like or molded material which is not malleable, is used as the base supporting structure 10 absorbent layer 12 may be forced under lip 14 and held in place. It should be understood that lip 14 in addition to providing means for securing absorbent layer 12 to supporting base structure 10 also provides sides such that substantial amounts of liquid over and beyond the absorption capabilities of absorbent layer 12 may be contained by the device. It should also be understood that if desired an adhesive may be applied between supporting base structure 10 and absorbent layer 12 as is shown at interface 16.

Figure 3:
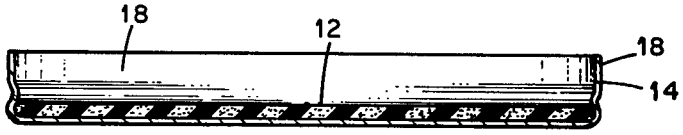

Although the embodiment described with respect to FIGS. 1 and 2 is capable of handling a substantial amount of liquid draining from the flower pot or vessel, FIGS. 3 through 6 illustrate embodiments which can contain very excessive amounts of liquid that has drained from the flower pot or vessel. For example, as is illustrated in FIG. 3 there is shown the rigid or semi-rigid base structure 10 and a absorbent layer 12 held in place by lip 14. It will be appreciated that reference numbers representing the same structural portions of the device of FIGS. 1 and 2 are also used to represent similar structural portions in the remaining Figures. Therefore, as is shown in FIG. 3, in addition to the absorbent layer 12 being held in place by the lip 14, there is also a raised side or edge 16 which is particularly effective in containing large excessive amounts of water over and beyond that which can be absorbed by absorbent layer 12.

Figure 4:
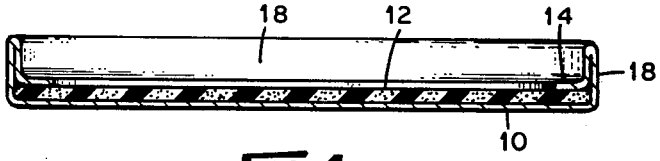

FIG. 4 shows a somewhat similar device also suitable for retaining excessive amounts of water. However as shown in FIG. 4 the edge or lip 18 is crimped down and around the absorbent material 12 and is therefore preferably made from sheet metal, aluminum tin foil or other malleable material.

Figure 5:
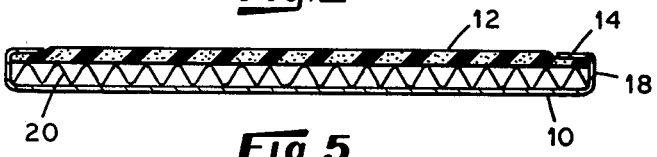
FIGS. 3 through 6 show cross-sectional areas of other possible embodiments of the present invention which has increased water containing capabilities.

FIG. 5 shows an embodiment of the present invention which is particularly suitable for containing the excessive water or liquid discussed with respect to FIGS. 3 and 4 and 5, but at the same time provides a barrier of absorbent material so that the excessive water or liquid will not be easily spilled if the device of this invention is inverted or tilted. As shown the device of FIG. 5 includes the rigid or semi-rigid base structure 10 and the absorbent layer 12 held in place by a lip 14. However, the device of this embodiment further includes spacer member 20 preferably made out of a corrugated wire, a wire mesh, corrugated plastic or a plastic mesh or other water impervious material such that the excess liquid is trapped in between the impervious base structure 10 and the absorbent layer 12. This embodiment operates in the following manner. Excess liquid draining from the flower pot passes through absorbent layer 12 into the space between the base structure 10 and layer 12. Therefore, before any of the collected liquid can be spilled, it must again pass through absorbent layer 12.

Figure 6:
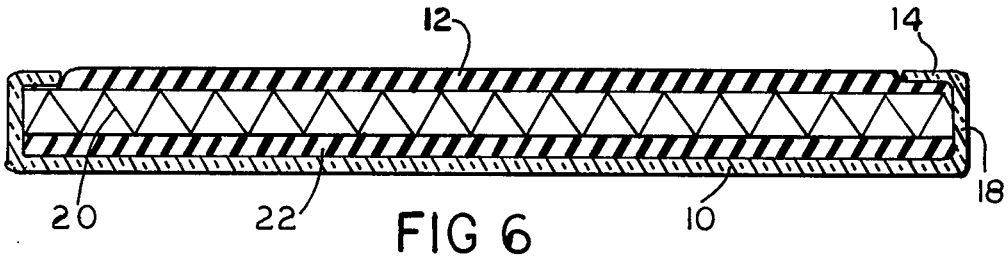

FIG. 6 shows an embodiment similar to that shown in FIG. 5 except it provides even better liquid absorbent qualities. In this embodiment, a second layer 22 of absorbent material is located between the rigid structure 10 and the spacer member 20. Thus, in this embodiment the excess liquid passes through the top absorbent layer of material 12 into the space 20 and then is finally absorbed by the second layer of this absorbent material 22.

Figure 7:
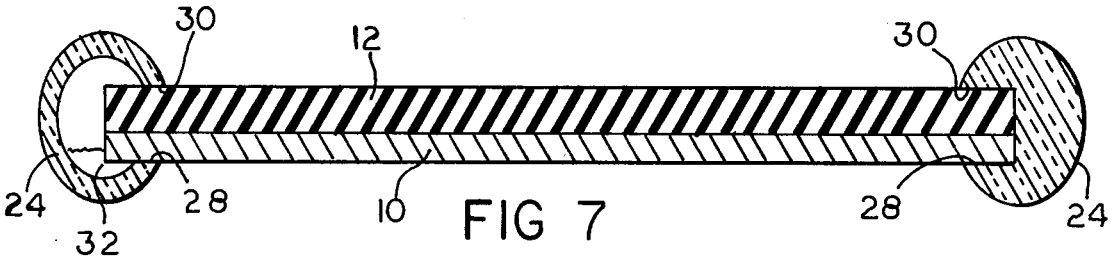
FIGS. 7, 8 and 9 show embodiments of the present invention wherein the base structure is made from two components.
Figure 8:
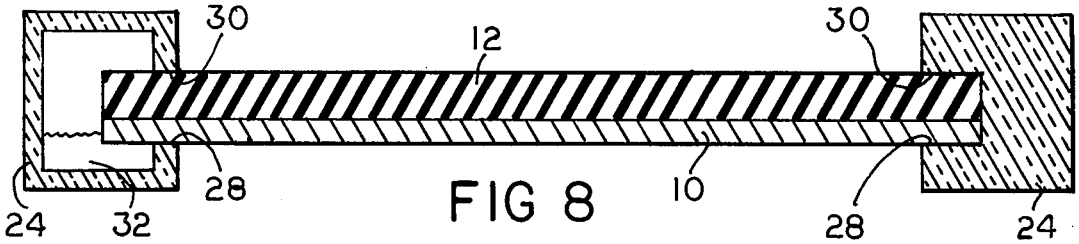
Figure 9:
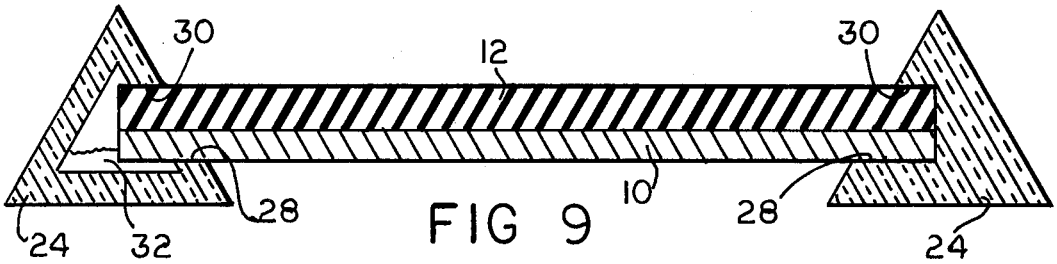

FIGS. 7, 8 and 9 show still another embodiment of the present invention which includes, as did embodiments discussed heretofore, a liquid impervious base structure 10 and a coplanar absorbent layer 12. However, unlike the previously discussed embodiments, base structure 10, includes neither lip 14 for securing absorbent layer 12 to base structure 10 nor the liquid containing sides 18 as an integral part of base structure 10. In their stead, rim member 24 fits around perimeter of base structure 10, in such a manner as to provide liquid retaining sides 26. It will be appreciated that rim member 24 may have substantially any desired cross section. For example, there is shown in FIG. 7, rim member 24 with a circular cross-sectional shape which is particularly economical. In this embodiment, therefore, if base structure 10 is also circular, rim member 24 will be toroidal in overall appearance. Other useful cross-sectional shapes for rim member 24 include rectangular, as is shown in FIG. 8 and triangular, as is shown in FIG. 9. As is shown in FIGS. 7, 8 and 9 the area of base structure 10, and absorbent layer 12 is larger than the area proscribed by the inside edge 26 of rim member 24. Consequently, once rim member 24 is in place and surrounds base structure 10 and absorbent layer 24, further securing means is not necessary for all uses. However, to provide a more stable or rigid device the distance between lip 32 and lip 34 of rim member 24 should be no greater than the combined thickness of base member 10 and absorbent layer 12. In such an embodiment rim member lips 32 and 34 securely clamp base member 10 and absorbent layer 12. Alternatively, base structure 10 may be bonded to lip member 32 of rim member 24. Such bonding may be accomplished by an adhesive, heat welding or the like. It will also be appreciated that lip 34 may be bonded to absorbent layer 34 if desired. However, according to the embodiments, illustrated on the left side of FIGS. 7, 8 and 9, lip 34 is not bonded to absorbent layer 12, and consequently excess liquid will wick pass edge 34 and be collected in the interior of rim member 24 as is shown at 36. Rim Member 24 may also have a solid cross-sectional area as is illustrated by the right hand side of FIGS. 7, 8 and 9. Commercially available carpet has been found particularly suitable for use as the base structure 10 and the absorbent layer 12 of the embodiments of this invention illustrated in FIGS. 7, 8 and 9.

I claim:

1. A protective device for supporting a vessel and containing liquid draining from said vessel, said device providing protection to furniture, shelving or other supporting structures on which the vessel may be set to avoid physical scratches and liquid staining or marring comprising:

a liquid impervious structure comprising a substantially flat member, and a rim member surrounding the perimeter of said flat member to provide sides suitable for containing a liquid, said rim member further including an edge for clamping; and a layer of absorbent and compressible material within said rim member and having a plane parallel and coextensive with said flat member, said layer of absorbent material being secured to said rim member and positively gripped by said edge for clamping such that excess liquid draining onto said protective device which is not absorbed by said layer of absorbent material is contained by said rim member and means which is parallel and has a plane coextensive with said flat member and said layer of absorbent material, and which is located between said flat member and said absorbent layer to provide spacing therebetween.

2. The protected device of claim 1 further including a second layer of absorbent material located between said means for providing spacing and said flat member, said second layer of absorbent material being placed in contact with and having a plane coextensive with said flat member.

3. The protected device of claim 1 wherein said layer of absorbent material and said flat member are made from carpet having a liquid impervious backing.

4. A protective device for supporting a vessel and containing liquid draining from said vessel, said device providing protection to furniture, shelving or other supporting structures on which the vessel may be set to avoid physical scratches and liquid staining or marring comprising:

a liquid impervious structure comprising a substantially flat member, and a rim member surrounding the perimeter of said flat member to provide sides suitable for containing a liquid, said rim member further including edges for clamping and positively gripping, and said rim member having a hollow cross-sectional area for providing additional capacity for containing liquids, a layer of absorbent material within said rim member and having a plane parallel and coextensive with said flat member, said layer of absorbent material being secured and positively gripped by said rim member edges, whereby excess liquid draining onto said protective device which is not absorbent by said layer of absorbent material is contained by said rim member.

* * * * *